United States Patent [19]

Russell et al.

[11] Patent Number: 4,802,150

[45] Date of Patent: Jan. 31, 1989

[54] MUD PRESSURE CONTROL SYSTEM WITH MAGNETIC TORQUE TRANSFER

[75] Inventors: Michael K. Russell; Anthony W. Russell, both of Cheltenham, England

[73] Assignee: NL Sperry Sun, Inc., Stafford, Tex.

[21] Appl. No.: 295,457

[22] Filed: Aug. 24, 1981

[30] Foreign Application Priority Data

Nov. 20, 1980 [GB] United Kingdom ..... 8037213

[51] Int. Cl.[4] ..... G01V 1/40

[52] U.S. Cl. ..... 367/85; 175/48; 33/306

[58] Field of Search ..... 367/85, 83; 166/66; 175/40, 45, 48, 50; 33/304, 306, 307; 324/369

[56] References Cited

U.S. PATENT DOCUMENTS

| | | | |
|---|---|---|---|
| Re. 30,246 | 4/1980 | Richter et al. | 367/83 |
| 2,700,131 | 1/1955 | Otis et al. | 367/83 |
| 3,867,714 | 2/1975 | Patton | 367/85 |
| 3,983,948 | 10/1976 | Jeter | 367/83 |
| 3,997,869 | 12/1976 | Claycomb | 367/83 |

OTHER PUBLICATIONS

Hirosura et al., "Results of Geothermal . . . Development", 9/27/79, Geotherm Resources Mtg, vol. 3, pp. 307–312, abst. only provided.

*Primary Examiner*—Nelson Moskowitz
*Attorney, Agent, or Firm*—Browning, Bushman, Zamecki & Anderson

[57] ABSTRACT

A down-hole signal generator for a mud-pulse telemetry system comprises a flow constrictor defining a throttle orifice for the mud passing along a drill string, a throttling member displaceable with respect to the throttle orifice to modulate the mud pressure for the purpose of transmitting measurement data up the drill string, and a turbogenerator. The turbogenerator incorporates an annular impeller surrounding a casing and arranged to be driven by the mud passing along the drill string, and a rotatable magnet assembly disposed in a mud-free environment within the casing. The impeller includes an electrically conductive drive ring and the rotatable magnet assembly includes rare earth magnets, so that, when the impeller is rotated by the mud flow, eddy currents are induced in the drive ring by the magnetic field associated with the magnets and the magnet assembly is caused to rotate with the impeller by virtue of the interaction between the magnetic field associated with the magnets and the magnetic field associated with the induced currents. In this manner torque may be imparted to an electrical generator within the casing without a rotating seal having to be provided between the impeller and the generator.

10 Claims, 4 Drawing Sheets

MUD PRESSURE CONTROL SYSTEM WITH MAGNETIC TORQUE TRANSFER

CROSS-REFERENCE TO RELATED APPLICATION

Applicant claims priority for this application from British Patent Application No. 8037213 filed on 20 Nov. 1980.

BACKGROUND OF THIS INVENTION

This invention relates to apparatus for signalling within a borehole while drilling, and is more particularly concerned with a down-hole signal transmitter for a mud-pulse telemetry system.

Various types of measurements-while-drilling (MWD) systems have been proposed for taking measurements within a borehole while drilling is in progress and for transmitting the measurement data to the surface. However, to date only one type of system has enjoyed commercial success, that is the so-called mud-pulse telemetry system. In that system the mud stream, which passes down the drill string to the drill bit and then back up the annular space between the drill string and the bore wall with the object of lubricating the drill string and carrying away the drilling products, is used to transmit the measurement data from a down-hole measuring instrument to a receiver and data processor at the surface. This is achieved by modulating the mud pressure in the vicinity of the measuring instrument under control of the electrical output signal from the measuring instrument, and sensing the resultant mud-pulses at the surface by means of a pressure transducer.

Current mud-pulse telemetry systems utilize a down-hole signal transmitter which is built into the drill collar. These systems therefore suffer from the disadvantage that, in the event of instrumentation failure in the transmitter, the complete drill string must be withdrawn to enable the faulty part to be replaced. Moreover the combined transmitter/drill collar is very costly to produce.

One such system comprises a turbine which is driven by the mud flow and drives an electrical generator for supplying the measuring instrument with power. The turbine also drives a hydraulic pump for displacing a throttling member to produce the required mud pulses. The displacement of the throttling member is determined by the electrical output of the measuring instrument. However, it is of the utmost importance that the mud should not penetrate into the housing containing the electrical generator and associated mechanism, and accordingly a rotating seal surrounds the shaft coupling the turbine to the generator. Such a seal is difficult to manufacture and prone to failure leading to the complete drill string having to be withdrawn and the drill collar having to be replaced.

It is an object of the invention to provide a generally improved down-hole signal transmitter for a mud-pulse telemetry system.

SUMMARY OF THE INVENTION

According to the invention there is provided a down-hole signal transmitter for a mud-pulse telemetry system, comprising a flow constrictor defining a throttle orifice for the mud passing along a drill string, a throttling member displaceable with respect to the throttle orifice to vary the throughflow cross-section of the throttle orifice, control means for displacing the throttling member to modulate the mud pressure, and a turbo-generator having an impeller arranged to be driven by the mud passing along the drill string and an electrical generator disposed in a mud-free environment within a casing, the impeller being magnetically coupled to the electrical generator to impart driving torque thereto.

Such an arrangement is particularly convenient as it not only generates the electrical power required for operating the measuring instrument and/or other devices, but also enables the generator to be maintained in a clean-fluid environment within the casing without a rotating seal having to be provided between the impeller and the generator.

Preferably the turbogenerator includes a rotatable magnet assembly within the casing adapted to rotate with the impeller and coupled to the generator, and the impeller comprises an electrically conductive ring surrounding the casing in the vicinity of the rotatable magnet assembly such that, when the impeller is rotated by the mud flow, eddy currents are induced in the electrically conductive ring by the magnetic field associated with the magnet assembly and the magnet assembly is caused to rotate with the impeller by virtue of the interaction between the magnetic field associated with the magnet assembly and the magnetic field associated with the induced currents. The electrically conductive ring preferably comprises an annulus of material, such as copper, of high electrical conductivity within which eddy currents may be induced surrounded by an annulus of highly magnetisable material, such as steel, which may provide a return path for the magnetic flux.

Alternatively the impeller may comprise a magnetisable ring surrounding the casing in the vicinity of the rotatable magnet assembly such that, when the impeller is rotated by the mud flow, the magnet assembly is caused to rotate with the impeller by virtue of the magnetic attraction between the magnet assembly and the magnetised ring. The magnetisable ring is preferably a hysteresis ring, that is a ring of ferromagnetic material, such as 35% cobalt-steel, having a high coercivity and therefore a hysteresis loop of large area, since the magnitude of the torque which may be transferred by the ring to the magnet assembly is dependent on the area of the hysteresis loop.

The magnet assembly is preferably a rare earth magnet assembly, that is a magnet assembly employing magnets, such as samarium-cobalt magnets, which incorporate rare earth elements. Such magnets have a very high coercivity so that, even when used in an open loop configuration, the magnets may be capable of inducing appreciable eddy currents in the electrically conductive ring or of magnetically saturating the magnetisable ring. Furthermore such magnets are almost impossible to demagnetise.

BRIEF DESCRIPTION OF THE DRAWINGS

In order that the invention may be more fully understood, a preferred form of down-hole signal transmitter in accordance with the invention will now be described, by way of example, with reference to the accompanying drawings, in which.

DETAILED DESCRIPTION OF THE INVENTION

Figure 1:
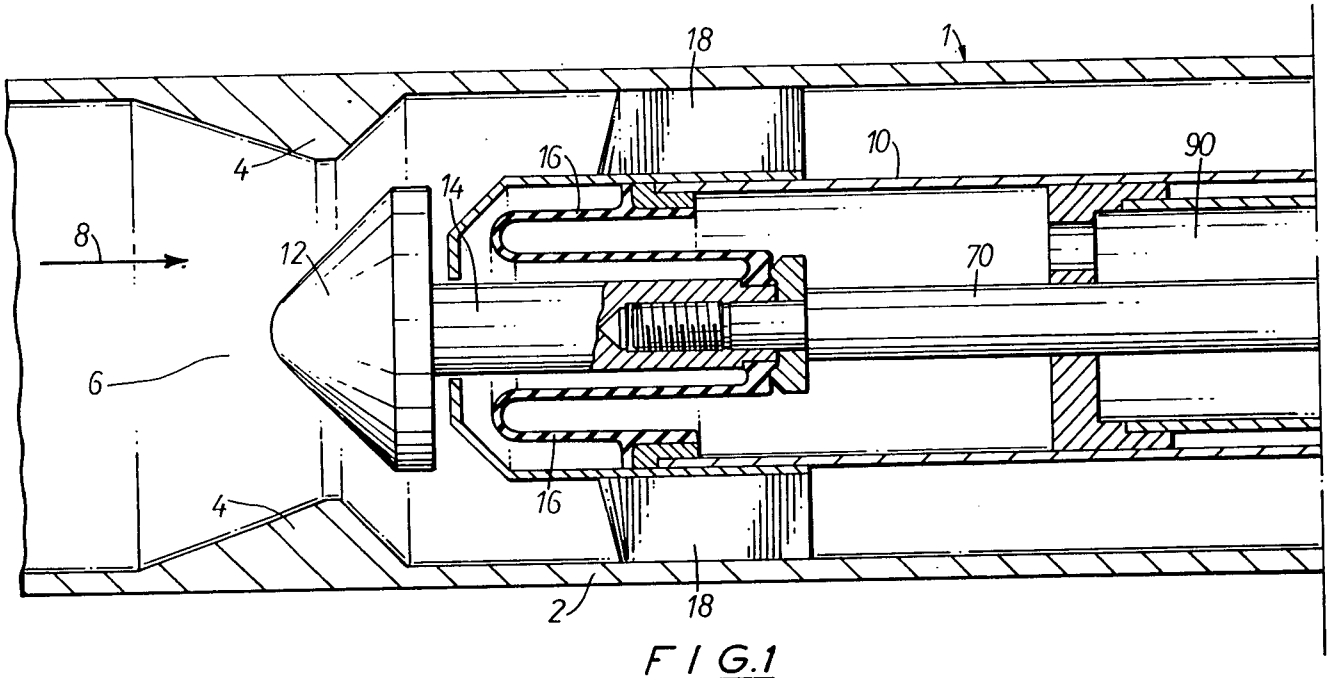
FIG. 1 is a longitudinal section through an upper part of the transmitter.

The signal transmitter 1 illustrated in the drawings is installed in use within a non-magnetic drill collar and coupled to a measuring instrument disposed in an instrument pressure casing installed within the drill collar immediately below the transmitter 1. The drill collar is disposed at the end of a drill string within a borehole during drilling, and the measuring instrument may serve to monitor the inclination of the borehole in the vicinity of the drill bit during drilling, for example. The signal transmitter 1 serves to transmit the measurement data to the surface in the form of pressure pulses by modulating the pressure of the mud which passes down the drill string. The transmitter 1 is formed as a self-continued unit and is installed within the drill collar in such a manner that it may be retrieved, in the event of instrumentation failure for example, by inserting a wireline down the drill string and engaging the wireline with a fishing neck on the transmitter, for example by means of a per se known gripping device on the end of the wireline, and drawing the transmitter up the drill string on the end of the wireline.

Figure 2:
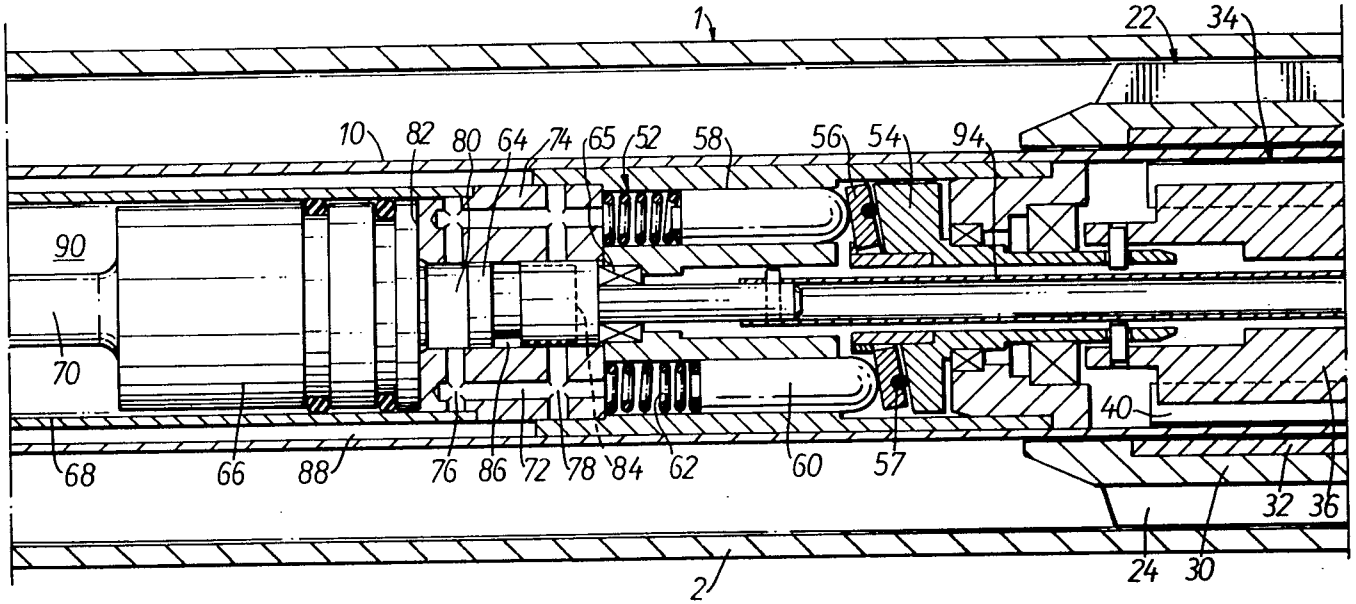
FIG. 2 is a longitudinal section through a central part of the transmitter.
Figure 3:
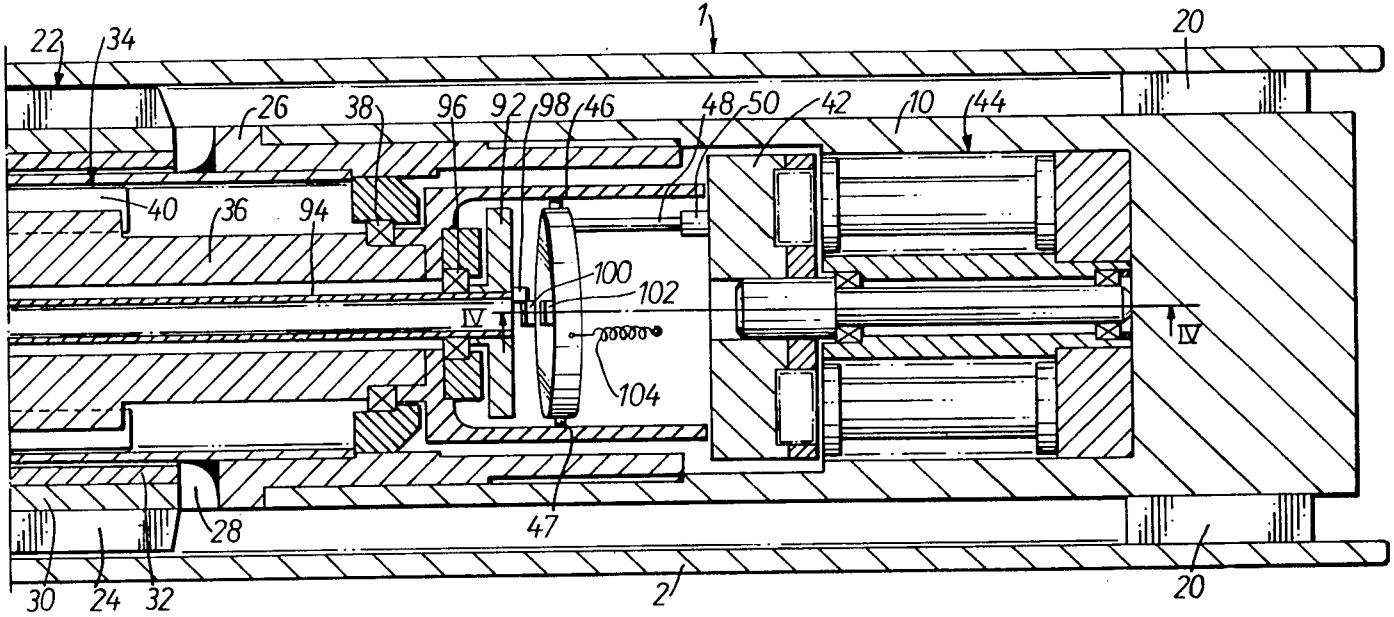
FIG. 3 is a longitudinal section through a lower part of the transmitter.

Referring to FIGS. 1 to 3, the transmitter 1 includes a duct 2 provided, at its upper end, with an annular flow constrictor 4 defining a throttle orifice 6 for the mud passing down the drill string in the direction of the arrow 8. Within the duct 2 is an elongate casing 10 bearing at its upper end, in the vicinity of the throttle orifice 6, a throttling member 12 which is displaceable with respect to the casing 10 in the direction of the axis of the duct 2 to vary the throughflow cross-section of the throttle orifice 6. The throttling member 12 is provided with a shaft 14 which extends into the casing 10, the space within the casing 10 being filled with hydraulic oil in order to ensure hydrostatic pressure balance and being sealed at its upper end by a Viton diaphragm 16 extending between the inside wall of the casing 10 and the shaft 14. The casing 10 is rigidly mounted within the duct 2 by three upper support webs 18 and three lower support webs 20 extending radially between the casing 10 and the duct 2, so as to provide an annular gap between the casing 10 and the duct 2 for mud flow.

An annular impeller 22 having a series of blades 24 distributed around its periphery and angled to the mud flow surrounds the casing 10, and is carried on a shoulder 26 of the casing 10 by means of a filled PTFE (polytetrafluoroethylene) thrust bearing 28. The blades 24 are mounted on a magnetisable steel boss 30 which surrounds a copper drive ring 32. A rare earth magnet assembly 34 is carried by an annular shaft 36 rotatably mounted within the casing 10 by means of bearings such as 38, and incorporates six Sm Co (samarium-cobalt) magnets 40 distributed about the periphery of the shaft 36. Three of the magnets 40 have their North poles facing radially outwardly and a further three of the magnets 40, alternating with the previous three magnets 40, have their South poles facing radially outwardly. As the impeller 22 rotates in the mud flow, eddy currents will be induced in the copper drive ring 32 by the intense magnetic field associated with the six Sm Co magnets 40, the magnetisable steel boss 30 providing return paths for the magnetic flux, and the magnet assembly 34 and hence the shaft 36 will be caused to rotate with the impeller 32 by virtue of the interaction between the magnetic field associated with the magnets 40 and the magnetic field associated with the eddy currents induced in the drive ring 32.

The annular shaft 36 drives a rotor 42 of an electrical generator 44 for supplying power to the measuring instrument by way of a circular escapement plate 46, pivotally mounted within the shaft 36 by pivot pins 47, and a torque drive arm 48 (see FIG. 4) attached to the periphery of the plate 46 and arranged to engage a drive pin 50 attached to the periphery of the rotor 42. In addition the annular shaft 36 drives a hydraulic pump 52 by way of an angled swashplate 54 and an associated piston thrust plate 56 provided with a bearing race 57.

The hydraulic pump 52 comprises eight cylinders 58 extending parallel to the axis of the casing 10 and arranged in an annular configuration, and a respective piston 60 associated with each cylinder 58. The lower end of each piston 60 is permanently biased into engagement with the thrust plate 56 by a respective piston return spring 62, so that rotation of the swashplate 54 with the shaft 36 will cause the pistons 60 to axially reciprocate within their cylinders 58, the eight pistons 60 being reciprocated cyclically so that when one of the pistons is at the top of its stroke the diametrically opposing pistons will be at the bottom of its stroke and vice versa. In addition the pump 52 comprises a rotary valve member 64 mounted on bearings 65 and intended to rotate in synchronism with the swashplate 54 so as to supply the output from each cylinder 58 in turn to one side of a double-acting ram 66 disposed within a cylinder 68. The double-acting ram 66 is coupled to the shaft 14 of the throttling member 12 by an output shaft 70, so that the throttling member 12 may be displaced by the pump 52 to vary the throughflow cross-section of the throttle orifice 6.

More particularly the hydraulic oil which fills the casing 10 and which is supplied to each of the cylinders 58 from one side of the double-acting ram 66 is forced by the associated piston 60 into a respective axial bore 72 in a valve housing 74 which surrounds the rotary valve member 64 on the upstroke of the piston 60. Each of the axial bores 72 is crossed by a respective lower radial bore 78. The rotary valve member 64 is provided with an upper peripheral recess 80 which opens out at the periphery of the valve member 64 over approximately 180° of arc and which also opens at the top of the valve member 64 into the lower part 82 of the cylinder 68 below the ram 66, and a lower peripheral recess 84 (shown in FIG. 2 in broken lines) which opens out at the periphery of the valve member 64 over approximately 180° of arc on the opposite side of the valve member 64 to the upper peripheral recess 80 and which also opens at its upper region into a central annular recess 86 formed in the valve member 64. The central annular recess 86 is permanently maintained in fluid communication with an annular passage 88 surrounding the cylinder 68 and valve housing 74 by radial passages (not shown) extending through the valve housing 74. The annular passage 88 is itself in fluid communication with the upper part 90 of the cylinder 68 above the ram 66.

There are two possible phases of rotation of the rotary member 64 with respect to the rotation of the swashplate 54, namely a first phase of rotation in which the upper peripheral recess 80 communicates with the upper radial bores 76 on the upstroke of the associated pistons 60 and the lower peripheral recess 84 communicates with the lower radial bores 78 on the downstroke of the associated pistons 60, and a second phase of rotation in which the upper peripheral recess 80 communicates with the upper radial bores 76 on the downstroke of the associated pistons 60 and the lower peripheral recess 84 communicates with the lower radial bores 78 on the upstroke of the associated pistons 60. Thus, during the first phase of rotation of the valve member 64, the input of the pump 52 will be connected to the upper part 90 of the cylinder 68 and the output of the pump 52 will be connected to the lower part 82 of the cylinder 68, so that the ram 66 and hence the throttling member 12 will be displaced upwardly. Conversely, during the second phase of rotation of the valve member 64, the input of the pump 52 will be connected to the lower part 82 of the cylinder 68 and the output of the pump 52 will be connected to the upper part 90 of the cylinder 68, so that the ram 66 and the throttling member 12 will be displaced downwardly.

The rotary valve member 64 is coupled to a torque-sensitive actuator, comprising a circular drive plate 92 disposed opposite the escapement plate 46, by a drive shaft 94 rotatably mounted within the annular shaft 36 by bearings 96. The drive plate 92 is provided with a driven pin 98 at its periphery which is engaged by a first escapement pin 100 at a first rotational position at the periphery of the escapement plate 46 in order to cause the valve member 64 to be driven by the shaft 36 with the first phase of rotation or alternatively by a second escapement pin 102 (see FIG. 4), which is disposed at a second rotational position offset by 180° with respect to the first rotational position at the periphery of the escapement plate 46, in order to cause the valve member 64 to be driven by the shaft 36 with the second phase of rotation.

Figure 4:
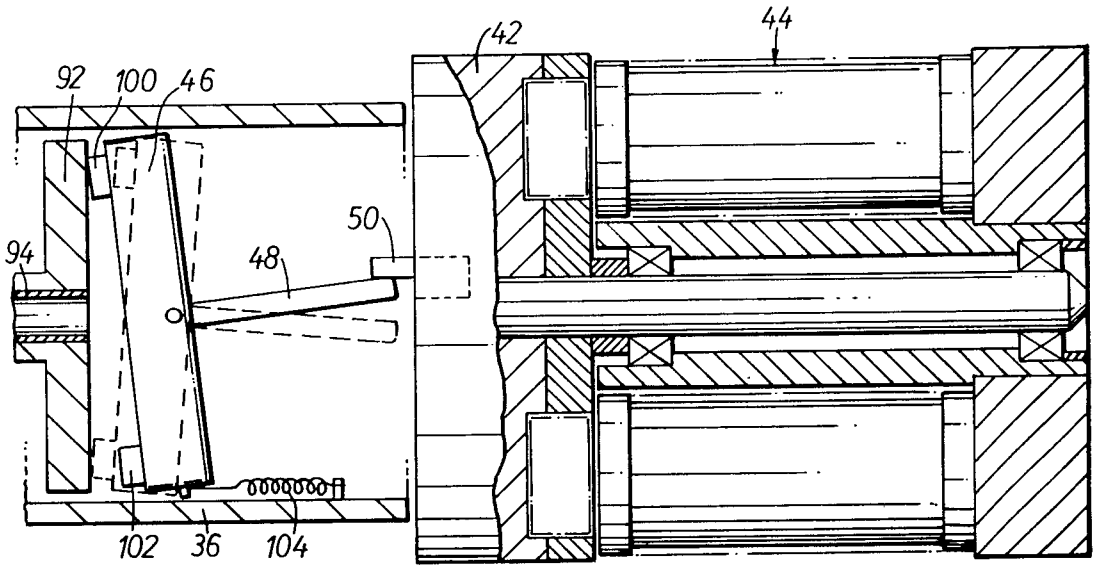
FIG. 4 is a longitudinal section through a portion of the lower part, taken along the line IV—IV in FIG. 3.

As shown clearly in FIG. 4, which shows a section taken along the line IV—IV in FIG. 3 but with the casing 10 and the duct 2 omitted, the escapement plate 46 is capable of being tilted about a tilt axis defined by the pivot pins 47 between a first angled position (shown in solid lines in FIG. 4) and a second angled position (shown in broken lines in FIG. 4). A tension spring 104 biases the escapement plate 46 into its first angled position. For relatively low electrical loads applied to the output of the generator 44, the escapement plate 46 will drive the drive plate 92 with the first phase of rotation by means of the first escapement pin 100 and will also drive the rotor 42 of the generator 44 by way of the torque drive arm 48. However, if the generator load increases to a point where the torque required to drive the rotor 42 is sufficient to overcome the bias of the spring 104, the torque drive arm 48 will be caused to tilt the escapement plate 46 into its second angled position against the action of the spring 104. This will cause the first escapement pin 100 to be brought out of engagement with the driven pin 98 of the drive plate 92, and the second escapement pin 102 to be engaged with the driven pin 98 after the escapement plate 46 has rotated through 180° with respect to the drive plate 92. This will cause the drive plate 92 to be driven with the second phase of rotation by means of the second escapement pin 102, and the supply of hydraulic fluid from the pump 52 to the double-acting ram 66 will be reversed. Of course, if the generator load subsequently decreases to a sufficient extent, the spring 104 will tilt the escapement plate 46 back into its first angled position, and the drive plate 92 will again be driven with the first phase of rotation.

It will therefore be appreciated that, if the measurement data from the measuring instrument is arranged to suitably vary the electrical load of the generator 44, the phase of rotation of the rotary valve member 64, and hence the direction of displacement of the double-acting ram 66, will vary with the output of the measuring instrument. This will in turn cause the throttling member 12 to be displaced with respect to the throttle orifice 6 to modulate the pressure of the mud flow upstream of the throttle orifice 6, and will produce a series of pressure pulses corresponding to the measurement data which will travel upstream in the mud flow and may be sensed at the surface by a pressure transducer in the vicinity of the output of the pump producing the mud flow. This arrangement therefore enables data in digital form to be transmitted to the surface.

What is claimed is:

1. A down-hole signal transmitter for a mud-pulse telemetry system, comprising a flow constrictor defining a throttle orifice for the mud passing along a drill string, a throttling member displaceable with respect to the throttle orifice to vary the throughflow cross-section of the throttle orifice, control means for displacing the throttling member to modulate the mud pressure, and a turbogenerator having an impeller arranged to be driven by the mud passing along the drill string and an electrical generator disposed in a mud-free environment within a casing, the impeller being magnetically coupled to the electrical generator to impart driving torque thereto.

2. A transmitter according to claim 1, wherein the turbogenerator includes a rotatable magnet assembly within the casing adapted to rotate with the impeller and coupled to the electrical generator.

3. A transmitter according to claim 2, wherein the impeller comprises an electrically conductive ring surrounding the casing in the vicinity of the rotatable magnet assembly such that, when the impeller is rotated by the mud flow, eddy currents are induced in the electrically conductive ring by the magnetic field associated with the magnet assembly and the magnet assembly is caused to rotate with the impeller by virtue of the interaction between the magnetic field associated with the magnet assembly and the magnetic field associated with the induced currents.

4. A transmitter according to claim 3, wherein the electrically conductive ring comprises an annulus of material of high electrical conductivity surrounded by an annulus of highly magnetisable material which provides a return path for the magnetic flux.

5. A transmitter according to claim 2, wherein the impeller comprises a magnetisable ring surrounding the casing in the vicinity of the rotatable magnet assembly such that, when the impeller is rotated by the mud flow, the magnet assembly is caused to rotate with the impeller by virtue of the magnetic attraction between the magnet assembly and the magnetised ring.

6. A transmitter according to claim 5, wherein the magnetisable ring is a hysteresis ring having a high coercivity and therefore a hysteresis loop of large area.

7. A transmitter according to claim 2, wherein the magnet assembly incorporates rare earth magnets.

8. A transmitter according to claim 7, wherein the rare earth magnets are samarium-cobalt magnets.

9. A transmitter according to claim 2, wherein the magnet assembly incorporates a plurality of magnets distributed around the periphery of a driven member with magnets having radially outwardly facing poles of one polarity alternating with magnets having radially outwardly facing poles of the opposite polarity.

10. A transmitter according to claim 1, wherein the control means includes a hydraulic pump for displacing the throttling member, the hydraulic pump being disposed within the casing and being arranged to be driven by the magnetic coupling.

* * * * *